US008544718B2

(12) United States Patent
Yamato et al.

(10) Patent No.: US 8,544,718 B2
(45) Date of Patent: Oct. 1, 2013

(54) PAPER CONTAINER FOR LIQUID

(75) Inventors: Shoji Yamato, Tokyo (JP); Yukinobu Yamaguchi, Tokyo (JP)

(73) Assignee: Dai Nippon Printing Co., Ltd., Tokyo-to (JP)

( * ) Notice: Subject to any disclaimer, the term of this patent is extended or adjusted under 35 U.S.C. 154(b) by 88 days.

(21) Appl. No.: 11/577,608

(22) PCT Filed: Oct. 20, 2005

(86) PCT No.: PCT/JP2005/019311
§ 371 (c)(1),
(2), (4) Date: Apr. 20, 2007

(87) PCT Pub. No.: WO2006/043633
PCT Pub. Date: Apr. 27, 2006

(65) Prior Publication Data

US 2009/0065558 A1 Mar. 12, 2009

(30) Foreign Application Priority Data

Oct. 20, 2004 (JP) ..... 2004-305581

(51) Int. Cl.
*B65D 5/56* (2006.01)

(52) U.S. Cl.
USPC ..... 229/5.84; 428/34.2

(58) Field of Classification Search
USPC ..... 229/5.84, 125.42, 137; 428/34.2
See application file for complete search history.

(56) References Cited

U.S. PATENT DOCUMENTS

| | | | | |
|---|---|---|---|---|
| 5,725,917 | A * | 3/1998 | Parks | 428/34.2 |
| 6,821,373 | B1 * | 11/2004 | Berlin et al. | 156/244.11 |
| 2002/0127382 | A1 * | 9/2002 | Susini | 428/218 |
| 2002/0143123 | A1 * | 10/2002 | Dekmezian et al. | 526/119 |
| 2002/0192405 | A1 * | 12/2002 | Schwartz et al. | 229/5.84 |

FOREIGN PATENT DOCUMENTS

| | | | | |
|---|---|---|---|---|
| EP | 781651 | A1 * | 7/1997 | 229/5.84 |
| JP | 10-58624 | | 3/1998 | |
| JP | 2000-33679 | | 2/2000 | |
| JP | 2004-250025 | | 9/2004 | |
| WO | 95/32094 | A1 | 11/1995 | |

* cited by examiner

*Primary Examiner* — Gary Elkins
(74) *Attorney, Agent, or Firm* — Ladas & Parry LLP

(57) ABSTRACT

The aim is to provide a paper container for liquid that has a strength to prevent breakage or leakage due to a shock in a long-distance transportation and also has no problems in opening the container when used.

Figure 1:
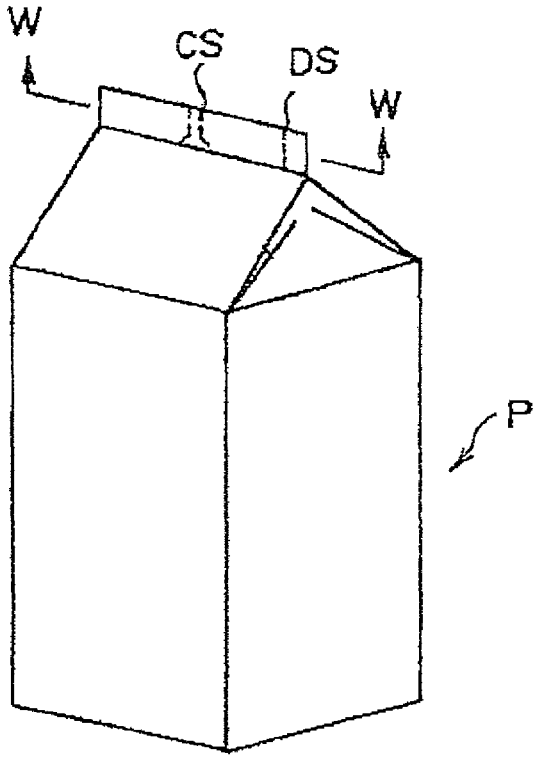
Figure 1:
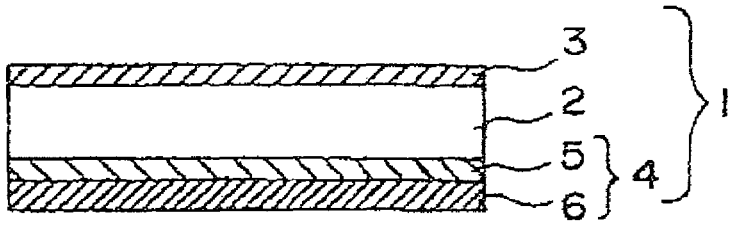

This invention is a paper container for liquid which comprises a laminated body which comprises a paper as base material thereof and a heat-sealant layer which is placed inner side of the container than the paper and which comprises a reinforcement layer and a liquid-contacting layer which is the side of contacting the liquid, wherein the reinforcement layer is a layer made of linear low-density polyethylene and the liquid-contacting layer is a layer made of low-density polyethylene and thickness ratio of the reinforcement layer and the liquid-contacting layer (thickness of reinforcement layer 5/thickness of liquid-contacting layer 6) that form the heat-sealant layer is in the range of 0.2-5. Moreover, it is characterized in that the density of the linear low-density polyethylene is in a range of 0.900-0.945 g/cm$^3$. Furthermore, it is characterized in that the linear low-density polyethylene and the low-density polyethylene are additive-free resins to which no additives have been added.

6 Claims, 2 Drawing Sheets

(a)

(b)

(a)

(b)

PAPER CONTAINER FOR LIQUID

TECHNICAL FIELD

The present invention relates to a paper container for liquid that involves milk, milky drink, juice, soft drink or the like and has superior formability of a container and sealing performance and especially relates to a paper container for liquid used for chilled distribution

TECHNICAL BACKGROUND

A gable top type or a brick type paper container for liquid which uses paper as its base material is formed by use of a laminated body in which various kinds of film materials are laminated to ensure the sealing performance, shelf life, rigidity or strength of the container. Specification of the laminated body differs for refrigerated distribution type and room temperature distribution, which includes one that enables long-term distribution, and is designed depending on the content and disinfecting method thereof, packaging method, set expiration date, or the like. Structure of packaging material for a conventional paper container for liquid such as milk used for refrigerated distribution (chilled distribution) is principally composed of low density polyethylene/paper/low density polyethylene, and since low density polyethylene (hereinafter referred to as LDPE) has good laminate workability when used as a sealant that forms a laminated body and heat-sealing properties when used to form a container, it is most commonly used. Especially for dairy products, additive-free LDPE which complies with ministerial ordinance regarding milk and the like is used.

However, it has a problem that when used as a paper container for liquid such as milk for refrigerated distribution (chilled distribution) and when the distance for distribution becomes long, breakage or leakage due to shocks occurs, which means that the structure of the material is not sufficient enough. To solve the problem, a paper container for liquid that uses a material adopting a structure of using linear low density polyethylene (hereinafter referred to as LLDPE) for a layer to be in contact with the liquid in order to increase strength against shocks or the like has been proposed (for example, refer to Patent Literature 1).

Patent Literature 1: Japanese Patent Unexamined Publication No. 2000-33679 (JP 2000-33679 A)

DISCLOSURE OF THE INVENTION

Problems to be Solved by the Invention

However, when the layer on the side of contacting the liquid is a layer of LLDPE, the sealing strength by the top seal becomes too strong when a paper container for liquid is formed and therefore, when the container is actually used by a customer, it becomes difficult for a user to open and for that reason, this cannot be practically used. Moreover, it also has a problem in its processing procedure such as lack of sliding property on its surface after formation of a film.

Therefore, the purpose of the present invention is to provide a paper container for liquid that has a strength to prevent breakage or leakage due to a shock in a long-distance transportation and also has no problems in opening the container when used.

Means for Solving Problem

As a result of our diligent study, we have found the present invention which is a paper container for liquid which comprises a laminated body which comprises a paper as base material thereof and a heat-sealant layer which is placed inner side of the container than the paper and which comprises a reinforcement layer and a liquid-contacting layer which is the side of contacting the liquid, wherein the reinforcement layer is a layer made of linear low-density polyethylene (LLDPE) and the liquid-contacting layer is a layer made of low-density polyethylene (LDPE) and thickness ratio of the reinforcement layer and the liquid-contacting layer (thickness of reinforcement layer 5/thickness of liquid-contacting layer 6) that form the heat-sealant layer is in the range of 0.2-5. Moreover, the present invention is characterized in that the density of the linear low-density polyethylene (LLDPE) is in a range of 0.900-0.945 g/cm$^3$. Furthermore, the present invention is characterized in that the linear low-density polyethylene (LLDPE) and the low-density polyethylene (LDPE) are additive-free resins to which no additives have been added.

Effects of the Invention

The paper container for liquid of the present invention makes it possible to obtain an increased anti-shock property and a strength that can prevent breakage or leakage in long-distance distribution, by adapting a multi-layer construction which has a layer of LLDPE, as the heat-sealant layer which comprises a reinforcement layer and a liquid-contacting layer, the heat-sealant layer being placed inner side of the container than the paper as the base material of the laminated body which is the material of the paper container, for example, by forming the heat-sealant layer by co-extrusion lamination of the LLDPE layer and LDPE layer.

Moreover, by making the liquid-contacting layer of the heat-sealant layer with an LDPE layer, it becomes possible to obtain a paper container for liquid that has sufficient sealing strength for practical use, does not cause any troubles when opened it as well as no problems in the sliding property of the inner surface, and has stable workability in the process of forming a paper container.

In addition, by using LLDPE which complies the ministerial ordinance regarding milk and the like, the paper container can be used as a paper container for liquid that is used for refrigerated distribution (chilled distribution) of milk or the like.

BRIEF DESCRIPTION OF THE DRAWINGS (FIG. 1) shows an embodiment of a paper container of the present invention, wherein (a) is a perspective view of the paper container, and (b) is a cross-sectional view that illustrates the constitution of a laminated body which constitutes the paper container.

(FIG. 2) is cross-sectional views taken along W-W line in FIG. 1, wherein (a) shows DS portion and (b) shows CS portion.

EXPLANATION OF THE NUMERALS

P paper container for liquid
X, Y gap
DS difference-in-level portion
CS center seal portion
1 laminated body
2 base material
3 surface resin layer
4 heat-sealant layer
5 reinforcement layer
6 liquid-contacting layer

THE BEST MODE FOR CARRYING OUT THE INVENTION

Figure 2:
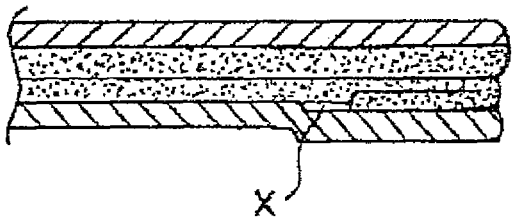
Figure 2:
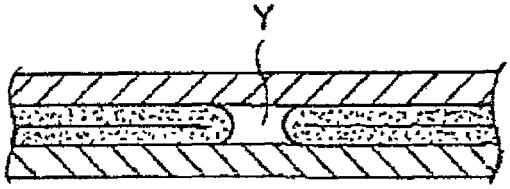

Hereafter, detailed embodiments of the present invention will be explained by referring to figures. Note that in this specification, a gable top type paper container for liquid is described as an embodiment of the container, including the figures. FIG. 1 shows an embodiment example of a paper container for liquid according to the present invention, wherein (a) is a perspective view of the paper container, and (b) is a cross-sectional view that illustrates the constitution of a laminated body which constitutes the paper container. FIG. 2 is across-sectional views taken along W-W line of FIG. 1, wherein (a) shows DS portion and (b) shows CS portion.

For a paper container P for a liquid of gable top type or the like, of which content is mainly liquid, a laminated body in which various materials are laminated is generally used, adopting a paper board as its core material, and as the configuration of the laminated body in the present invention, as shown in FIGS. 1 (*a*) and (*b*), a surface resin layer 3 is provided on one surface (top side surface) of a base material layer 2 and on the other surface (back side surface), a heat-sealant layer 4 is provided for a laminated body 1, by which the paper container P for a liquid is manufactured. Because a liquid-contacting surface side of the heat-sealant layer 4 comes into direct contact with the content, it must be one that does not change or deteriorate the property of the content, and it must be the one that has sealing property that can prevent the content from leaking from the paper container P for a liquid. Moreover, air-tightness to shut off the flow of air is also required.

It is needless to say that the sealed paper container P for a liquid should not allow leakage of the liquid from any portion thereof. For example, in case of a gable top type paper container for liquid, due to the structure of the container, portions such as a gap X in an difference-in-level portion DS, which is a sealing end of a sealing plate, as shown in FIG. 2 and, as shown in FIG. 2 (*b*), a gap Y in center seal portion CS of gable top (roof top) part. The gaps X and Y which are formed in the difference-in-level portion DS and the center seal portion CS are the portions where special attention is required when they are surely sealed by melted resin. Although the upper part of the paper container P for a liquid has been explained, in the bottom part thereof, there are portions where leakage easily occurs, or airtightness is easily spoiled. There is a possibility that these portions are broken by damages or the like in the way of distribution to cause leakage of liquid. Especially, in case of a long-distance distribution, the risk becomes higher.

In the present invention, paper is used as the base material 2 and a paper of which weighing capacity is in the range of 10-600 g/m$^2$ is preferably used. For example, when a paper container for liquid is prepared, in the case that the rigidity as the container is required, a paper which is called a paper board having a weighing capacity of 100-500 g/cm$^2$ is preferably used.

The present invention enabled to provide properties and function as the container for liquid by adopting a double-layered structure which is comprised of the reinforcement layer 5 and the liquid-contacting layer 6 as the heat-sealant layer 4 of the paper container P for a liquid. That is, as shown in FIG. 1 (*b*), the double-layered structure of the heat-sealant layer 4 uses LLDPE as the reinforcement layer 5 which is placed on the laminated side to the paper and uses LDPE as the liquid-contacting layer 6 which is placed on the liquid-contacting surface side that comes into contact with the content.

To obtain the heat-sealant layer 4 of the present invention, the layer may be manufactured by a film forming method of, for example, co-extrusion of two kinds of resin, namely, LLDPE as the reinforcement layer 5 and LDPE as the liquid-contacting layer 6, or by a film lamination method. As the film forming method by using co-extrusion, more concretely, T-die co-extrusion method, co-extrusion inflation method, co-extrusion lamination method, or the like can be enumerated and as the film lamination method, concretely, dry lamination method can be enumerated, for example.

Among these methods, a film forming method by co-extrusion is preferable. The co-extrusion forming method does not require drying process of solvent in adhesive used for processing such in the film lamination method and therefore solvent drying process is not necessary and is superior in productivity as compared with the film lamination. Although it is possible to form a layer by forming a film by in the inflation method or T-die method, in that case, there are two steps in the process, which are a step of forming a film and a step of laminating it to the paper. Therefore, a method of forming a laminated body by directly performing co-extrusion lamination on the surface of paper using a laminator in which an extrusion equipment is mounted is preferable and as a result, it becomes possible to make a laminated body in one step of process.

As mentioned above, the heat-sealant layer 4 is provided on the inner side (back surface side) of paper which is the base material for the laminated body of the paper container for liquid, LDPE can be laminated on the outer side (top surface side) thereof by use of the conventionally known extrusion laminator. As the top surface resin layer 3 on the top surface side, it is preferable to use LDPE which is the same resin used as the liquid-contacting layer 6 in the heat-sealant layer 4 in order to make heat-sealing property with the back surface side layer good.

The paper container P for a liquid of the present invention is an invention that solves the problems of heat-sealing property (airtightness), opening property, anti-shock property, or the like, by adopting a double-layered structure as the heat-sealant layer 4, the double-layered structure including an LLDPE layer which is the reinforcement layer 5 and an LDPE layer which is the liquid-contacting layer 6.

In the present invention, the LLDPE which is the resin used for the reinforcement layer 5 that constitutes the heat-sealant layer 4 denotes a copolymer of ethylene and α-olefin. As α-olefin, straight chain or branched chain olefins having a carbon number of between 3 and 20 are preferable, and for example, propylene, 1-butene, 1-pentene, 1-hexene, 3-methyl-1-butene, 4-methyl-1-pentene, 1-octene, 1-decene, or the like can be enumerated. More preferably, straight chain or branched chain olefins having a carbon number of between 6 and 20 are desirable, and for example, 1-hexene, 3-methyl-1-butene, 4-methyl-1-pentene, 1-octene, and 1-decene can be enumerated. When the carbon number of straight or branched chain olefin is less than 3, strength of the copolymer is weakened, and when the number exceeds 20, it is not preferable for manufacturing from economical viewpoint. Moreover, it is possible to use two or more of these copolymers in combination. Among the copolymers, ethylene-1-hexene copolymer, ethylene-4-methyl-1-pentene copolymer, and ethylene-1-octene copolymer are preferable from the viewpoints of the strength and the economical viewpoint.

Furthermore, LLDPE polymerized by using a metallocene catalyst is superior in its mechanical property such as tensile strength, tearing strength, penetrating strength or the like as compared with LLDPE polymerized by using a Ziegler-Natta catalyst, and thus it can be preferably used. Here, a single-site catalyst (metallocene catalyst, involving so-called Kaminsky catalyst) has a characteristic that active site thereof is uniform (single-site). This single-site catalyst is a catalyst consisting of metallocene type transitional metal compound and organic aluminum compound, and may be supported by an inorganic material to be used.

Here, as the metallocene type transitional metal compound, for example, the enumerated are compounds in which one or two groups among cyclopentadienyl group, substituted cyclopentadienyl groups, indenyl group, substituted indenyl groups, tetrahydroindenyl group, substituted tetrahydroindenyl groups, fluonyl group and substituted fluonyl groups, or a cross-linked body in which two groups selected from the above mentioned functional groups are bonded covalently, is bonded to a transitional metal selected from the IVB group (titanium (Ti), zirconium (Zr), or hafnium (Hf)), and which may further include a substituent which involves hydrogen atom, oxygen atom, halogen atoms, alkyl groups, alkoxy groups, aryl groups, acetylacetonate groups, carbonyl groups, nitrogen molecule, oxygen molecule, Lewis bases, and silicon atom, or a ligand such as unsaturated hydrocarbons or the like.

As the organic aluminum compound, alkyl aluminum, chained or cyclic aluminoxane or the like can be enumerated. Here, alkyl aluminum includes triethyl aluminum, triisobutyl aluminum, dimethyl aluminum chloride, diethyl aluminum chloride, methyl aluminum dichloride, ethyl aluminum dichloride, dimethyl aluminum fluoride, diisobutyl aluminum hydride, diethyl aluminum hydride, ethyl aluminum sesquichloride or the like.

Incidentally, chained or cyclic aluminoxane is produced by contacting alkyl aluminum with water. For example, chained or cyclic aluminoxane can be obtained by adding alkyl aluminum when polymerized and water is added later, or by reacting crystalline water of complex salt or absorped water of organic or inorganic compound with alkyl aluminum.

As the LLDPE which is usable in the present invention, those which have a density in the range of 0.900-0.945 g/cm$^3$ are preferable, and more desirably, in the range of 0.905-0.920 g/cm$^3$. Incidentally, this density is a value measured according to ISO 1872-2 (JIS K6922-2). When the density of LLDPE is less than 0.900 g/cm$^3$, sealing strength becomes too strong after top-sealed and formed into a shape of a paper container for liquid, and it is liable to cause the failure in opening operation. On the other hand, when the density of LLDPE exceeds 0.945 g/cm$^3$, sealing property on the manufacturing of the paper container for liquid becomes insufficient and which may cause leakage.

In addition, for dairy products, additive-free LLDPE that complies with the ministerial ordinance regarding milk and the like is used. The additive-free LLDPE is resin which does not include any additive such as antioxidant, ultraviolet absorber, antistatic agent, lubricant, anti-blocking agent, flame retardant, pigment, dye, and inorganic or organic filler.

That is, in the case of LLDPE, reaction catalyst is always used for ion polymerization, and generally, chlorine type catalyst containing chloride tetrachloride is used. Because chloride has corrosive properties, calcium stearate or the like should be used for neutralization, and due to this fact, calcium chloride, stearic acid, or the like are produced, and LLDPE cannot come into the additive-free form. Because the LLDPE used in the present invention is one which catalyst used in the polymerization is a non-chlorine type, and therefore there is no need to add a neutralizing agent, the LLDPE can be obtained as the additive-free form.

Moreover, as the resin used for the liquid-contacting layer 6, LDPE can be preferably used. The LDPE for this purpose is generally obtained by the polymerization under the presence of a radical polymerization initiator and under a high pressure in the range of 500-7000 atmospheres, and one characteristic of the resin is to be in possession of many long branched-chains. Because of this structure of having such a long branched-chains, it is known to have superior extrusion property, and particularly, it is preferably used for extrusion lamination method.

In addition, for dairy products, additive-free LDPE that complies with the ministerial ordinance regarding milk and the like is used. The additive-free LDPE is resin which does not include any additive such as antioxidant, ultraviolet absorber, antistatic agent, lubricant, anti-blocking agent, flame retardant, pigment, dye, and inorganic or organic filler.

Thickness of the heat-sealant layer 4 in the laminated body used for the paper container P for a liquid according to the present invention is in the range of 20-100 μm and, more preferably, in the range of 30-60 μm.

When the thickness of the heat-sealant layer 4 is less than 20 μm, a pinhole may easily be produced in a gap of a heat sealing portion. On the other hand, when the thickness of the heat-sealant layer 4 exceeds 100 μm, it takes time to perform heat sealing and the efficiency for manufacturing the paper container for liquid becomes low.

With respect to the thickness of LLDPE which forms the reinforcement layer 5, it is preferable to be in the range of 10-50 μm. When the thickness is less than 10 μm, the effect to strengthen the anti-shock property cannot be expected, while when the thickness exceeds 50 μm, the seal strength becomes too strong, which is followed by a bad opening property on usage.

With respect to the thickness of LDPE which forms the liquid-contacting layer 6, it is preferable to be in the range of 10-50 μm. When the thickness is less than 10 μm, the effect to strengthen the anti-shock property cannot be expected, while when the thickness exceeds 50 μm, the sealing strength becomes too strong, which is followed by a bad opening property on usage.

In addition, it is preferable that thickness ratio of reinforcement layer 5 and liquid-contacting layer 6 (thickness of reinforcement layer 5/thickness of liquid-contacting layer 6) when double-layered structure is adopted for the heat-sealant layer 4 is in a range of 0.2-5, and more preferably, in a range of 0.3-3. When the thickness ratio of the reinforcement layer 5 and the liquid-contacting layer 6 is less than 0.2, the effect to strengthen the anti-shock property cannot be expected, while when it exceeds 5, the sealing strength becomes too strong, which is followed by a bad opening property on usage.

It is conceivable that the sealant layer 4 is made as a single layer of LLDPE. However, in that case, the liquid-contacting surface side of the laminated body 1 is obliged to be formed by the LLDPE layer, and therefore the sliding property becomes inferior, which is followed by a trouble in supplying a blank at a flame sealer on the manufacturing process of a paper container for liquid. The blank supplying part of the flame sealer where many blank sheets are mounted therein adopts a method of sliding out a blank sheet one by one with a high speed from a lower part thereof in order to supply the blank sheets to the flame sealer part, and thus if the sliding property of the surface of blank is not enough, it will cause a result that the surface of another blank is damaged by the blank slid out.

As shown in FIG. 1 (*b*), in the paper container for liquid of the present invention, since the liquid-contacting layer 6 of the laminated body 1 that configures the paper container P for a liquid is the LDPE layer, it has an appropriate surface sliding property, and it stable in supply and does not give damages to other blanks.

Moreover, with respect to the sealing property by heat sealing in the heat-sealant layer 4 of the paper container P for a liquid according to the present invention, it is possible to fill gaps X and Y of the difference-in-level portion DS and center seal portion CS in the heat seal portions for forming a paper container for liquid with melted resin.

As described above, the laminated body 1 of the paper container P for a liquid according to the present invention can be prepared, for example, by extrusion lamination of LDPE on the outer side (top surface side) of the paper as the base material layer 2 in accordance with the conventionally known method, and by co-extrusion lamination of LLDPE as the reinforcement layer 5 and LDPE as the liquid-contacting layer 6 wherein the LLDPE and LDPE are co-extruded and simultaneously they are adhered and layered as the heat sealant layer 4 on the inner surface (back surface side) of the paper.

When adapting the co-extrusion lamination method as the lamination process of the laminated body of packaging material that configures a paper container for liquid, it becomes unnecessary to prepare a co-extrusion film by a separate process. In addition, since in the co-extrusion lamination the temperature of resins is high, the adhere strength of resin to the paper become stable.

Furthermore, in the co-extrusion lamination method, it is preferable to perform one or more of various preliminary treatments such as corona treatment, ozone treatment, flaming treatment, low-temperature plasma treatment, electron beam irradiation treatment, and ultraviolet irradiation treatment in order to enhance the adhesiveness between the paper as the base material layer 2 and LLDPE as the reinforcement layer 5. Among the above, the corona treatment is preferably used because it is relatively easy and highly effective

EXAMPLES

The present invention will be described by examples. In accordance with the following Examples and Controls, laminated bodies were manufactured, then paper containers for a liquid were formed, and, thereafter, the containers were filled with content in order to elevate various properties.

Example 1

First, on the top surface side of a milk carton base paper, as a base material, having a weighing capacity of 313 g/m$^2$, additive-free LDPE (LC520, manufactured by Japan Polyethylene Corporation) was extruded to coat the paper so that the thickness of LDPE becomes 20 μm, while on the other surface side, additive-free LDPE (LC520, manufactured by Japan Polyethylene Corporation) as a liquid-contacting layer and LLDPE (KC573, manufactured by Japan Polyethylene Corporation, density: 0.910 g/cm$^3$) as a reinforcement layer were co-extruded and laminated so that thicknesses thereof become 20 μm and 20 μm, respectively, and thus a laminated body 1A having following configuration was prepared. LDPE 20 μm/paper 313 g/m$^2$/LLDPE 20 μm/LDPE 20 μm Then using this laminated body 1A, a gable top type paper container of which capacity is 1000 ml was manufactured by a conventionally known method. Thereafter, the obtained container was filled with milk as content, and then sealed in order to obtain a paper container A for a liquid.

Example 2

First, on the top surface side of a milk carton base paper, as a base material, having a weighing capacity of 313 g/m$^2$, additive-free LDPE (LC520, manufactured by Japan Polyethylene Corporation) was extruded to coat the paper so that the thickness LDPE becomes 20 μm, while on the other surface side, additive-free LDPE (LC520, manufactured by Japan Polyethylene Corporation) as a liquid-contacting layer and additive-free LLDPE (NH745N, manufactured by Japan Polyethylene Corporation, density; 0.910 g/cm$^3$) as a reinforcement layer were co-extruded and laminated so that thicknesses thereof become 20 μm and 20 μm, respectively, and thus a laminated body 1B having following configuration was prepared.

LDPE 20 μm/paper 313 g/m$^2$/LLDPE 20 μm/LDPE 20 μm

Then, using this laminated body 1B, a gable top type paper container of which capacity is 1000 ml was manufactured by a conventionally known method. Thereafter, the obtained container was filled with milk as content, and then sealed in order to obtain a paper container B for a liquid.

Example 3

First, on the top surface side of a milk carton base paper, as a base material, having a weighing capacity of 313 g/m$^2$, additive-free LDPE (LC520, manufactured by Japan Polyethylene Corporation) was extruded to coat the paper so that the thickness LDPE becomes 20 μm, while on the other surface side, additive-free LDPE (LC520, manufactured by Japan Polyethylene Corporation) as a liquid-contacting layer and additive-free LLDPE (NH745N, manufactured by Japan Polyethylene Corporation, density; 0.910 g/cm$^3$) as a reinforcement layer were co-extruded and laminated so that thicknesses thereof become 10 μm and 30 μm, respectively, and thus a laminated body IC having following configuration was prepared.

LDPE 20 μm/paper 313 g/m$^2$/LLDPE 30 μm/LDPE 10 μm

Then, using this laminated body IC, a gable top type paper container of which capacity is 1000 ml was manufactured by a conventionally known method. Thereafter, the obtained container was filled with milk as content, and then sealed in order to obtain a paper container C for a liquid.

(Control 1)

First, on the top surface side of a milk carton base paper, as a base material, having a weighing capacity of 313 g/m$^2$, additive-free LDPE (LC520, manufactured by Japan Polyethylene Corporation) was extruded to coat the paper so that the thickness of LDPE becomes 20 μm, while on the other surface side, additive-free LDPE (LC520, manufactured by Japan Polyethylene Corporation) was extruded and laminated so that thickness thereof becomes 40 μm, and thus a laminated body 1X having following configuration was prepared. LDPE 20 μm/paper 313 g/m$^2$/LDPE 40 μm Then, using this laminated body 1X, a gable top type paper container of which capacity is 1000 ml was manufactured by a conventionally known method. Thereafter, the obtained container was filled with milk as content, and then sealed in order to obtain a paper container X for a liquid.

(Control 2)

First, on the top surface side of a milk carton base paper, as a base material, having a weighing capacity of 313 g/m$^2$, additive-free LDPE (LC520, manufactured by Japan Polyethylene Corporation) was extruded to coat the paper so that the thickness LOPE becomes 20 μm, while on the other surface side; additive-free LLDPE (NH745N, manufactured by Japan Polyethylene Corporation) as a liquid-contacting layer and additive-free LDPE (LC520, manufactured by Japan Polyethylene Corporation) as a reinforcement layer were co-extruded and laminated so that thicknesses thereof become 20 μm and 20 μm, respectively, and thus a laminated body 1Y having following configuration was prepared.

LDPE 20 μm/paper 313 g/m$^2$/LDPE 20 μm/LLDPE 20 μm

Then, using this laminated body 1Y, a gable top type paper container of which capacity is 1000 ml was manufactured by a conventionally known method. Thereafter, the obtained container was filled with milk as content, and then sealed in order to obtain a paper container Y for a liquid.

With respect to the paper containers for a liquid manufactured in above mentioned Examples 1, 2, and 3 and Controls 1 and 2 respectively, comparison tests were performed on the following properties.

1) Vibration Test

The samples were stored in dozen crates. Then, to their respective three crates, vibrations only in the vertical direction were applied in 15-minute intervals up to 60 minutes in order to compare leakage.

(Vibration condition) Vibration frequency: 0.8 Hz, amplitude: 5.5 mm

2) Drop Test

Each sample was dropped from 60 cm height to a concrete surface in order to compare counts of dropping until leakage is happened.

3) Sealing Property

By use of a filling machine manufactured by Chubu Machinery Works Co., Ltd., (capacity 150 containers/hour), sealing properties were compared. (Proper sealing temperature: 450° C.)

4) Opening Property

Opening properties of samples of which top seal temperatures in the sealing property tests have been varied were compared.

5) Sliding Property

Sliding properties of the inner surface (liquid-contacting surface) were compared.

TABLE 1

<Results in vibration test>

| Vibration time | Example 1 | Example 2 | Example 3 | Control 1 | Control 2 |
|---|---|---|---|---|---|
| 15 mins. | 0/36 containers | 0/36 containers | 0/36 containers | 1/36 containers | 0/36 containers |
| 30 mins. | 0/36 containers | 0/36 containers | 0/36 containers | 3/36 containers | 0/36 containers |
| 45 mins. | 1/36 containers | 1/36 containers | 1/36 containers | 8/36 containers | 0/36 containers |
| 60 mins. | 1/36 containers | 1/36 containers | 1/36 containers | 16/36 containers | 1/36 containers |

TABLE 2

<Results in drop test>
Dropping Times until leakage was happened n = 5

| | Example 1 | Example 2 | Example 3 | Control 1 | Control 2 |
|---|---|---|---|---|---|
| Times | 9.5 (8, 11) | 9.2 (7, 11) | 9.2 (7, 13) | 4.8 (4, 6) | 10.1 (9, 11) |

Each number in the table represents an average value
Numbers in bracket in the table show (minimum value, maximum value)

TABLE 3

<Results in sealing property>
Sealing property test for top portion

| Top seal Temperature | | Example 1 | Example 2 | Example 3 | Control 1 | Control 2 |
|---|---|---|---|---|---|---|
| 420° C. | Seal | ○ | ○ | ○ | Δ | ○ |
| | Broiling Pinhole | ○ | ○ | ○ | ○ | ○ |
| 440° C. | Seal | ○ | ○ | ○ | Δ | ○ |
| | Broiling Pinhole | ○ | ○ | ○ | Δ | ○ |
| 460° C. | Seal | ○ | ○ | ○ | ○ | ○ |
| | Broiling Pinhole | Δ | Δ | Δ | ▲ | Δ |
| 480° C. | Seal | ○ | ○ | ○ | ○ | ○ |
| | Broiling Pinhole | Δ | Δ | Δ | X | Δ |

* Evaluation criteria
Sealing property:
Good ○ → Δ → ▲ → X Bad
Broiling Pinhole: Small ○ → Δ → ▲ → X Many

TABLE 4

<Results in opening property>
Evaluation of opening property of top portion

| Top seal Temperature | Example 1 | Example 2 | Example 3 | Control 1 | Control 2 |
|---|---|---|---|---|---|
| 420° C. | ○ | ○ | ○ | ○ | X |
| 440° C. | ○ | ○ | ○ | ○ | X |
| 460° C. | ○ | ○ | ○ | ○ | X |
| 480° C. | ○ | ○ | ○ | ○ | X |

* Evaluation criteria
Opening property; Good ○ → Δ → ▲ → X Bad

TABLE 5

<Results in sliding property>
Inner surface sliding angle (back surface/stainless plate)

| | Example 1 | Example 2 | Example 3 | Control 1 | Control 2 |
|---|---|---|---|---|---|
| Sliding angle | 25.7 | 25.8 | 25.7 | 25.7 | 31.2 |

Evaluations in comparison tests for Examples 1, 2, and 3 and Controls 1 and 2 with respect to the respective paper containers for a liquid are as follows.

1) Vibration Test

It was confirmed that Examples 1, 2, and 3 which have reinforcement layers made from LLDPE are superior to Control 1 with respect to the leakage caused by vibration. In addition, Control 2 for which LLDPE is used for liquid-contacting layer showed good a result, too.

2) Prop Test

It was confirmed that Examples 1, 2, and 3 which have reinforcement layers made of LLDPE are superior to Control 1 with respect to the leakage caused hydropping. In addition, Control 2 for which LLDPE is used for liquid-contacting layer showed good a result, too.

3) Sealing Property

It was confirmed that Examples 1, 2, and 3 which have reinforcement layers made of LLDPE are superior to Control 1 with respect to the sealing properties, as well as the anti-pinhole properties. In addition, Control 2 for which LLDPE is used for liquid-contacting layer showed a good result, too.

4) Opening Property

Examples 1, 2, and 3 which have reinforcement layers made of LLDPE and Control 1 showed good results, while Control 2 was not good.

5) Sliding Property

Examples 1, 2, and 3 which have reinforcement layers made of LLDPE and Control 1 showed good results, while Control 2 was not good.

From the results shown above, it was confirmed that Examples 1, 2, and 3 which have reinforcement layers made of LLDPE are superior to Control 1 which does not have a reinforcement layer made of LLDPE in vibration test, drop test, sealing property, and opening property. In addition, Control 2 for which LLDPE was used as a liquid-contacting layer did not show good opening and sliding properties.

As a conclusion, a paper container for liquid that is constituted with a laminated body that includes a liquid-contacting layer made of LDPE and a reinforcement layer made of LLDPE showed good results in all of the vibration test, drop test, sealing property, opening property, and sliding property.

Industrial Utilities

The present invention can be widely used for a paper container for liquid which has superior forming property, sealing property, etc. for containing milk, milky drink, juice, soft drink or the like. Especially, this can be applied to a paper container for liquid used for chilled distribution which requires long-distance transportation and of which content is dairy product.

The invention claimed is:

1. A paper container for liquid comprising:

a laminated body which comprises a paper as base material thereof and a heat-sealant layer which is placed inner side of the container than the paper, wherein the heat-sealant layer comprises a reinforcement layer and a liquid-contacting layer which is the side of contacting the liquid, wherein the reinforcement layer consists of a linear low-density polyethylene and the liquid-contacting layer consists of a low-density polyethylene, wherein the linear low-density polyethylene is a copolymer of ethylene and $\alpha$-olefin.

2. The paper container for liquid according to claim 1, wherein thickness ratio of the reinforcement layer and the liquid-contacting layer, thickness of reinforcement layer (5)/thickness of liquid-contacting layer (6), is in the range of 0.2-5.

3. The paper container for liquid according to claim 1 or 2, wherein density of the linear low-density polyethylene is in a range of 0.900-0.945 g/cm$^3$.

4. The paper container for liquid according to claim 1 or 2, wherein the low-density polyethylene (LDPE) is an additive-free resin to which no additives have been added.

5. The paper container for liquid according to claim 1 or 2, wherein the linear low-density polyethylene is metallocene linear low-density polyethylene.

6. The paper container for liquid according to claim 1 or 2, wherein the linear low-density polyethylene is a member selected from the group consisting of ethylene-1-hexene copolymer, ethylene-4-methyl-1-pentene copolymer, and ethylene-1-octene copolymer.

* * * * *